US006367094B1

(12) United States Patent
Gagliano

(10) Patent No.: US 6,367,094 B1
(45) Date of Patent: Apr. 9, 2002

(54) MULTI-STEP OPERATING SYSTEM FOR ROTATING HIDEAWAY SANITARY FIXTURES, UTILIZING A PRESSURIZED FLUID DISTRIBUTION

(75) Inventor: Vitaliano Gagliano, Passignano sul Trasimeno (IT)

(73) Assignee: Sanygen S.r.l., Spoleto (IT)

( * ) Notice: Subject to any disclaimer, the term of this patent is extended or adjusted under 35 U.S.C. 154(b) by 0 days.

(21) Appl. No.: 09/408,721

(22) Filed: Sep. 29, 1999

(30) Foreign Application Priority Data

Sep. 29, 1998 (IT) ..... PG98A0041

(51) Int. Cl.[7] ..... E03D 11/12

(52) U.S. Cl. ..... 4/312

(58) Field of Search ..... 4/312, 307, DIG. 2

(56) References Cited

U.S. PATENT DOCUMENTS 2,611,134 A * 9/1952 Jarrett et al. ..... 4/312
4,944,047 A * 7/1990 Gagliano ..... 4/312
5,134,728 A * 8/1992 Sturm ..... 4/312 X

* cited by examiner

*Primary Examiner*—Charles E. Phillips
(74) *Attorney, Agent, or Firm*—Chernoff, Vilhauer, McClung & Stenzel, LLP

(57) ABSTRACT

A fluid system for rotating hideaway sanitary fixtures provides for simultaneous discharge and turnover of the fixture by virtue of hydraulic devices only.

8 Claims, 15 Drawing Sheets

MULTI-STEP OPERATING SYSTEM FOR ROTATING HIDEAWAY SANITARY FIXTURES, UTILIZING A PRESSURIZED FLUID DISTRIBUTION

BACKGROUND OF THE INVENTION

Points of comparison are lacking, due to both the originality of invention and the fact that it concerns improvements in a product, still covered by patent in various countries, of A.T. Avanzata Tecnologia S.r.l., hence reference will be made only to the current operating system used in the "rotating hideaway sanitary fixtures."

The "rotating hideaway sanitary fixtures," presently produced only by us since we represent the only entitled party, are moved by electrical devices, whose operational sequence is guaranteed by a programmed microprocessor.

For both the WC (water closet) and bidet, the opening and closing steps are performed by a double-acting hydraulic piston assembly, a casing or cylinder of which is fixed to a stationary structure, and a piston rod of which, at the other end, is fixed to the sanitary fixture by an integral pivot. The sanitary fixture is fully opened (preparation for use) when the rod is fully out. Total re-entry of the piston rod into its casing results in the total reentry of the sanitary fixture (rest position).

Appropriately pressurised mains water is supplied to the piston chambers through solenoid valves, causing the piston rod to come out or re-enter, thus opening or closing the sanitary fixture.

Moreover, for the WC, this sequence provides for the discharge of waste water with the sanitary fixture in the open position, as occurs with all presently known sanitary fixtures, using mains or stored water, provided it is pressurised.

In order to carry out the opening, closing and especially discharge operations, the water system must have a pressure of at least 2.5–3 bar and the amount of water is well in excess of the scheduled standards.

DRAWBACKS AND OBJECTIVES

In light of the new European provisions concerning water consumption, it results that the current operating system used in "rotating hideaway sanitary fixtures" does not conform. These regulations provide for a drastic reduction in consumption of WC discharge systems, obviously maintaining equal operating efficiency.

Further problems noticed up to now in the current system are listed below.

In the case of WCs:

limited installation possibilities due to water system (water mains) characteristics, in terms of pressure and flow rate;

also in installations where the water system meets the necessary pressure characteristics, the simultaneousness of other water feeds in the same system, for instance in hotels or condominiums, may jeopardise both movement and discharge efficiency;

poor customer acceptance of a system that foresees the use of electricity near water in addition to an increased risk of breakdowns. Also the danger of a blackout and therefore the fear of not being able to use the WC, could be psychologically counterproductive.

In the case of bidets:

limited installation possibilities due to water system characteristics, in terms of pressure and flow rate;

also in installations where the water system meets the necessary pressure characteristics, the simultaneousness of other water feeds in the same system, for instance in hotels or condominiums, may jeopardise both movement and discharge efficiency;

poor customer acceptance of a system that foresees the use of electricity near water in addition to an increased risk of breakdowns. Also the danger of a blackout and therefore the fear of not being able to use the bidet, could be psychologically counterproductive.

SUMMARY OF THE INVENTION

Therefore the intended aims are as follows:

1—to guarantee the washing and discharge efficiency with reduced water consumption in compliance with the new European provisions;

2—to ensure WC and bidet operation even with very restricted water pressures of the water mains and therefore without particular problems also during moments of a notable reduction in pressure due to the cited factors of simultaneousness;

3—to achieve the automation of the movement and discharge steps, avoiding the use of electricity.

Other aims achieved, even if not sought, which arise from the choices made are as follows:

4—the distributor device in the system of the patent application could combine, in the bidet's case, also the functions of supply and mixing of hot and cold water as well as the opening and closing of the sanitary fixture;

5—the distributor device in the system of the patent application could combine, in the WC's case, also the function of just an internal sanitary fixture cold water supply, through the discharge pipe of the flush tank, as well as functions relating to the opening, closing and discharge of the sanitary fixture;

6—obtain a totally guaranteed safety system in the sanitary fixture's closing step which prevents the trapping of limbs inadvertently placed in the spaces between the housing niche and the sanitary fixture itself, in compliance with that provided for in the "Machine directive";

7—the possibility of using the traditional air controlled flush tanks.

DESCRIPTION

Premise

In order to achieve these aims, starting with the main one of obtaining an efficient WC discharge with reduced water consumption, it was necessary to make the discharge action occur at the same time as a partial and adjustable closing of the sanitary fixture. This is achieved with a new device called a "metering device" whose function is that of injecting a specific amount of water into the hydraulic piston assembly for movement, so that the sanitary fixture partially closes and stays as such. This device will make it possible to determine the amount of water to be sent to the piston so as to regulate the turnover position adopted by the sanitary fixture during the discharge step.

The other aims were reached by using only the energy coming from the network's (mains) hydraulic feed, thus totally eliminating the need for electricity. Obviously, it was necessary to make adjustments to the componentry design to satisfy the new operational criterion.

In particular, in order to achieve automation of the system's various steps, without electricity and microprocessor control, use is made of a new, manually operated device called a "distributor", fed by pressurised mains water which, depending on the operating handle's position and hence the part remaining inside, directs water towards the pipe corresponding to the desired function. The "distributor" contains a special device (no. 13 FIG. 7) that ensures the water system's separation upstream of the entire system (upon closure of the sanitary fixture), so as to avoid problems caused by sudden increases in pressure peaks.

A suitable membrane tank, which during use has stored water and therefore energy, allows the re-closing of the sanitary fixture, even if the system at this stage is separate from the water feed system.

Before going on to describing the invention and its associated devices, it is pointed out that:

- the first objective of reducing water consumption with equal WC discharge efficiency, which requires that the discharge action occurs at the same time as a partial and adjustable closing of the sanitary fixture, can also be achieved in the present system with electricity and microprocessor control, without having to fit in new devices, only by appropriately reprogramming the various functions;
- in the systems shown, which are part of the patent application, where a traditional air controlled WC flush tank is used, the device that operates the discharge is shown incorporated in the "metering" device for the turnover of the sanitary fixture; such a device may also be separate.

DESCRIPTION OF THE PREFERRED EMBODIMENTS

The parts making up the system will now be briefly described to enable a more detailed explanation of the system's operation.

DS Distributor

Figure 7:
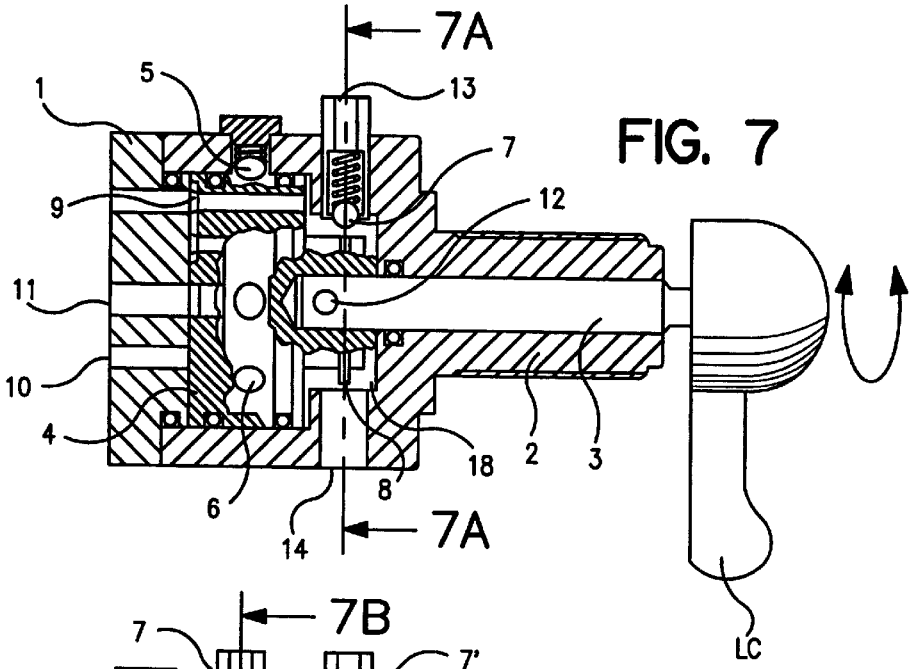
FIGS. 7 and 8 are axial sections of distributor examples, in particular for WC control (FIG. 7) with only a cold water feed or supply 13, and for a bidet (FIG. 8) with a cold water feed or supply 7, and a hot water feed or supply 7'.

A rotary distributor DS for toilets, or WC, shown in axial section in FIG. 7 basically includes a stationary casing 1 and a rotor 4 or rotary body.

The casing 1, forms an inlet chamber 18, that houses the rotor. The stationary casing has a head 2, with several through channels, for instance 9, 10, 11 (axial), for fluid pipe connection.

In its side wall, casing 1 houses a spring rotor locking device 5 for locking the rotor, a valve 7 for mains water inlet and a connection 14 for an expansion tank.

The rotor or rotary piston 4 is connected by a plug or joint 12, to a control rod 3 which is an integral part of a control lever LC.

The rotary piston or body is in sealing contact against the side wall and a head of the stationary casing 1, is rotatable in the stationary casing around the axis a as shown by the arrow, is manually controlled for example by the lever LC that turns the rod 3, and may be secured in each one of a plurality of preset positions by means of the device 5. This device includes a spring biased retaining ball 5*a*, which engages a recess of a plurality of recesses 6 spaced out along a peripheral band of rotor 4. The rotor 4 has several bores which may or may not be in register with the channels of the stationary casing, depending on the position selected for the rotor 4.

Adhesion or contact between the surfaces of casing 1 (stationary) and rotor 4 is ensured by the water pressure on the opposite surface to that of contact. This is useful in order to eliminate any elastic body (springs, etc. ) that could perform the same function, and in order to improve the seal in direct proportion to the pressure of the water supply system or mains whose values, as is known, vary throughout the day.

Figure 7A:
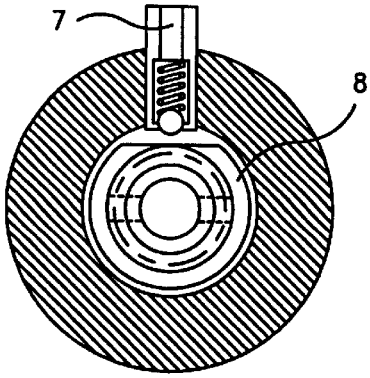
FIGS. 7A and 7B are sectional views according to plans A in FIG. 7B in FIG. 8, to show a closed position, FIG. 7A, and an open position, FIG. 7B, of the valve on the water mains supply.
Figure 7B:
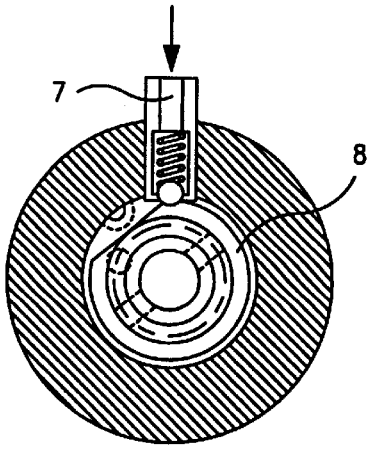

Valve 7, for the mains water supply, is a check valve including a spring biased ball. A cam 8 (FIGS. 7, 7A) mounted on the rotor cooperates with it and has a part circular shape, in plan view, with a part of reduced radius. For some positions of the lever LC, as that shown in FIG. 7, there is no connection between the water supply system or mains and the distributor's interior, whereas when cam 8 is placed with its peripheral circular part of greater radius against the ball of valve 7, biasing it against the spring, mains water can flow inside the distributor.

Figure 8:
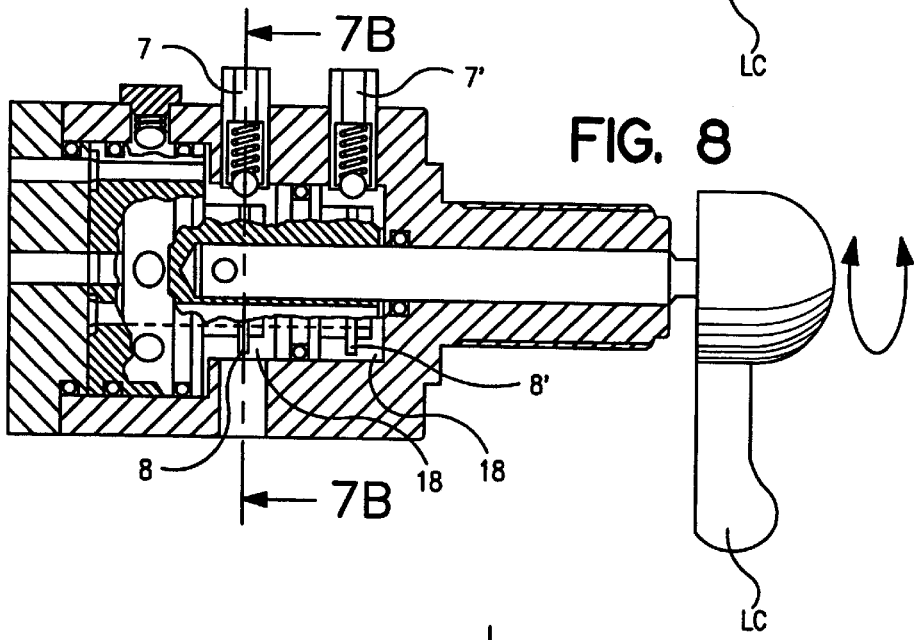

The distributor in FIG. 8, for a bidet, has an additional entry 7', for hot water, with a relative cam device 8'.

The above mentioned rotary distributors are only examples of various possible rotary distributors. It is also possible to use linear movement type distributors. However, it is crucial that the distributor has a mains water entrance and the possibility of taking a plurality of positions, namely: a closed sanitary fixture rest position (first position); a sanitary fixture open position (second position); a sanitary fixture closed position (third position which may correspond to the first position); a discharge position (fourth position, only for WCs); a position for water washing or supply (fifth position, optional) for WCs; an area in which cold and hot water is supplied and mixed for bidets (optional).

Flush tank C The flush tank C is a traditional flush tank, and is pneumatically controlled.

Membrane tank A

The membrane or expansion tank A is also of traditional type.

Metering device D- Discharge actuator S

A metering and discharge actuator device DA includes a cylinder-piston unit D for water, having a piston D3 (defining chambers D1 and D2) whose stroke is adjustable by fitting in a lock F on piston rod D4, further includes a cylinder-piston unit S, having a piston S3, the rod S4 thereof being exposed to pressure in chamber D2. The piston S3 defines a chamber S1 in communication with the atmosphere and a chamber S2, connected to a discharge primer line L7, which is generally air fed. A spring M acts on the piston S3 contrasting the action of pressure in D2, and is calibrated so as to exert on S3 a smaller force than that applied by pressure in D2.

The operation of the system of the invention will now be described, reference being made to the drawings.

Figure 1:
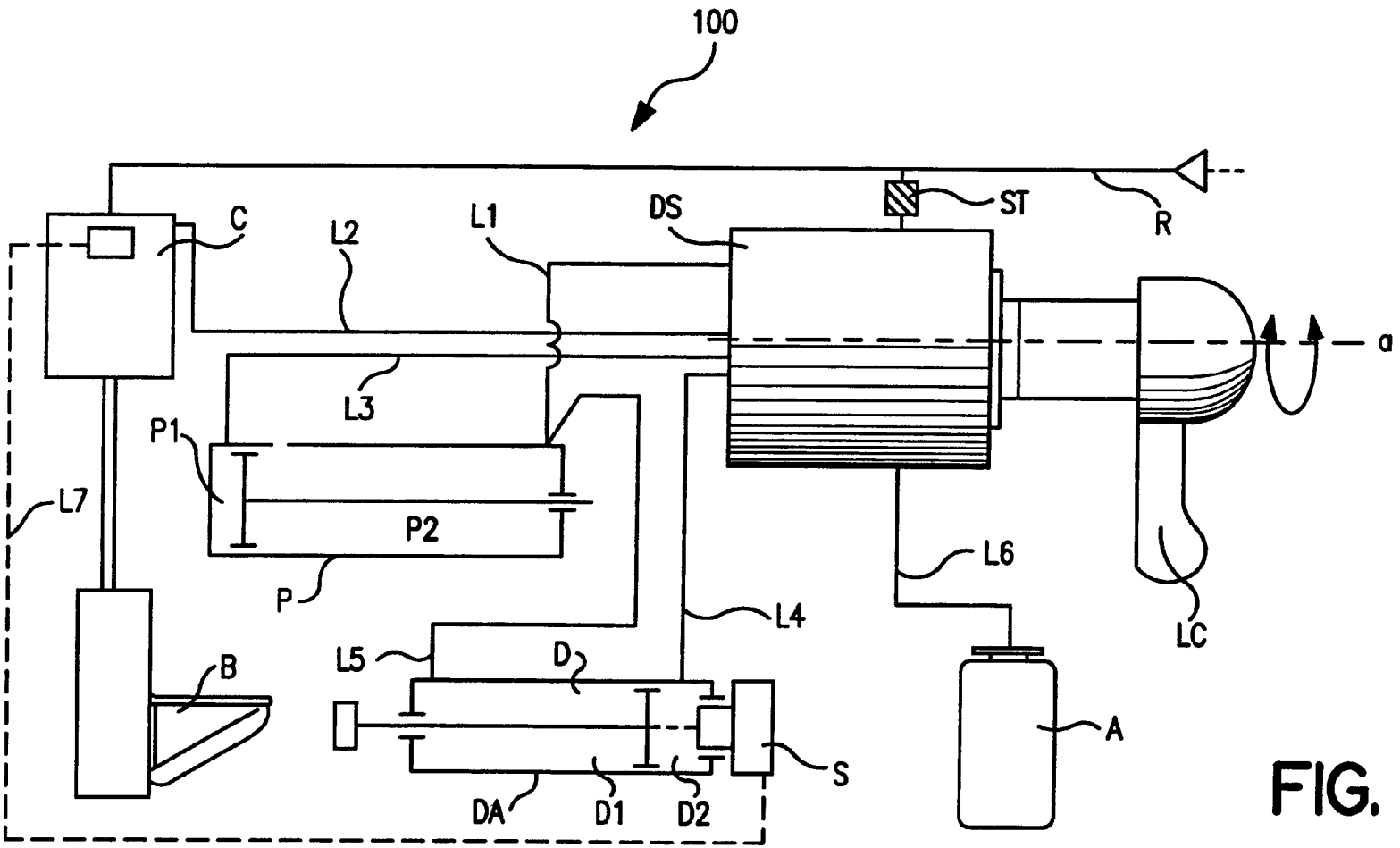
FIG. 1 diagrammatically shows a movement and feed system of a rotating hideaway sanitary fixture, in particular a WC, in a first embodiment.
Figure 2:
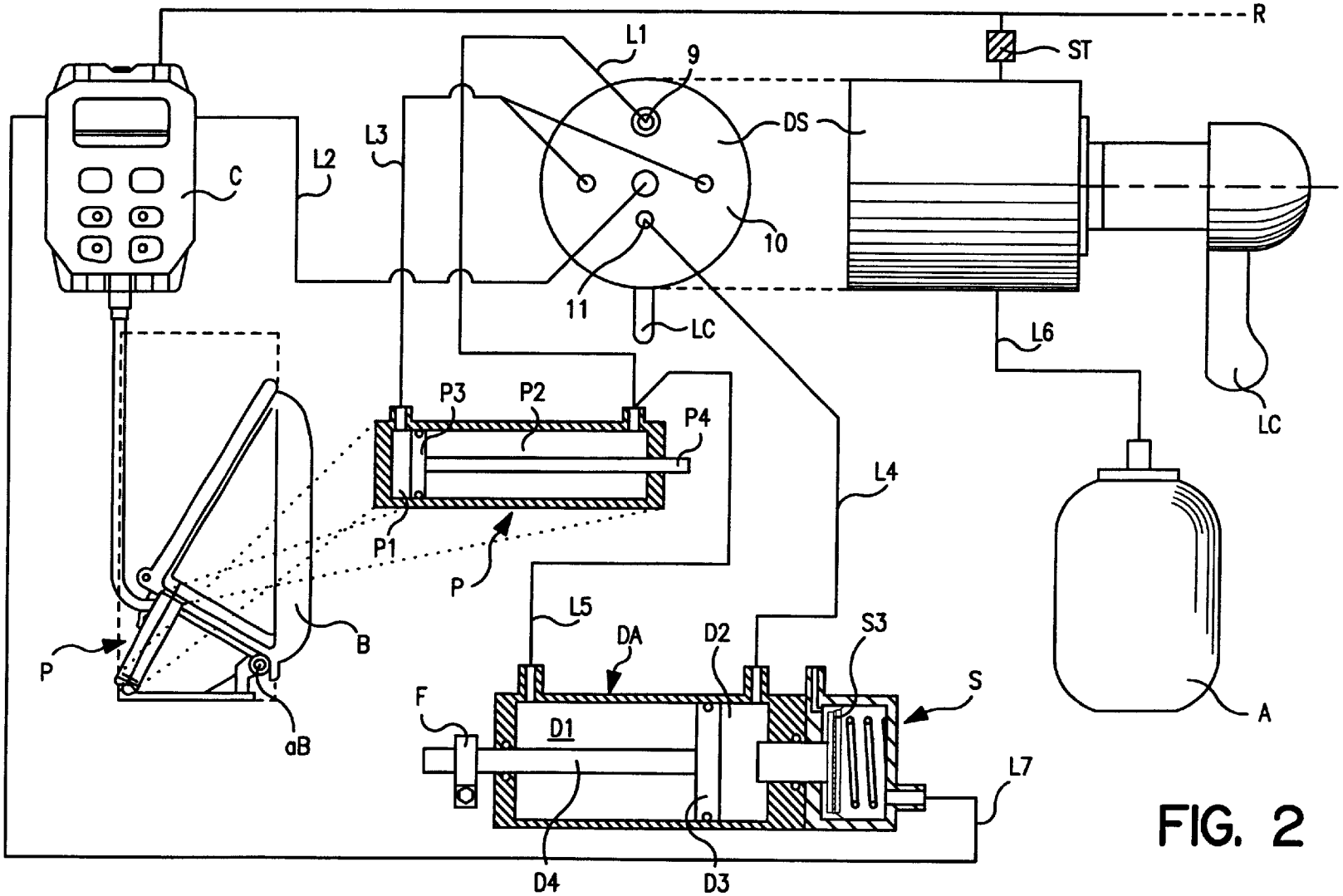
FIG. 2 shows the system in FIG. 1 in greater detail, in a rest position, with the rotating hideaway sanitary fixture B, in particular a WC, raised in a retracted or rest condition; the distributor DS is shown both in side view as well as in an end view from the left in the figure, for ease of illustration; a piston P that for illustrative purposes is shown in the central part of the drawing, in actual fact, represents one or two cylinders located behind and to the side of the sanitary fixture B; a "metering" device DA; a discharge operating device S; a traditional flush tank C; a membrane tank A; a mains water supply R.

With initial reference to FIG. 1, a first exemplary system according to the invention, for supply and movement of a rotating hideaway sanitary fixture B (in particular, a WC), is referenced 100 and includes; a control distributor DS, manually or otherwise operated, of which the movable control lever, referenced LC rotates around axis a; a container or discharge and accumulation flush tank, referenced C; a cylinder-piston unit P, for raising-lowering the sanitary fixture (that is shown at the center of the drawing for illustrative purposes only; it actually consists of one or two cylinders situated behind and laterally of sanitary fixture B, as seen in FIG. 2, for instance); a metering and discharge actuator unit DA, including a metering device portion D, and a discharge operating portion S; a traditional type expansion tank, referenced A; preferably an adjustable pressure stabilizer, ST, on a mains water supply, R.

Among the said elements, the system includes: a pipe or line L1 between the distributor and a chamber P2 of the cylinder-piston unit P for raising-lowering the sanitary fixture; a line L2 between the distributor and the flush tank C; a line L3 between the distributor and the other chamber P2 of the cylinder-piston unit P; a line L4 between the distributor and a chamber D2 of the metering and discharge actuator unit DA; a line L5 between the chamber P2 of the cylinder-piston unit P and the other chamber D1 of the metering-actuator DA; a line L6 between the distributor and the expansion tank A; a line L7 for the passage of air between the discharge operating device S of the unit DA and the flush tank C.

In a rest position, the system is in the condition shown in FIG. 2. The distributor (FIG. 7) has the lever LC, hence the rotor, in the rest position, in which valve 7 between the water supply system R and the distributor's interior 18 is closed. The sanitary fixture B is in a raised, closed, out of the way condition, i.e. the cylinder-piston P unit (or units) is in a retracted condition, the chamber P2 is extended, chamber P1 is reduced. The energy reserve formed by the expansion tank A is discharged.

Figure 3:
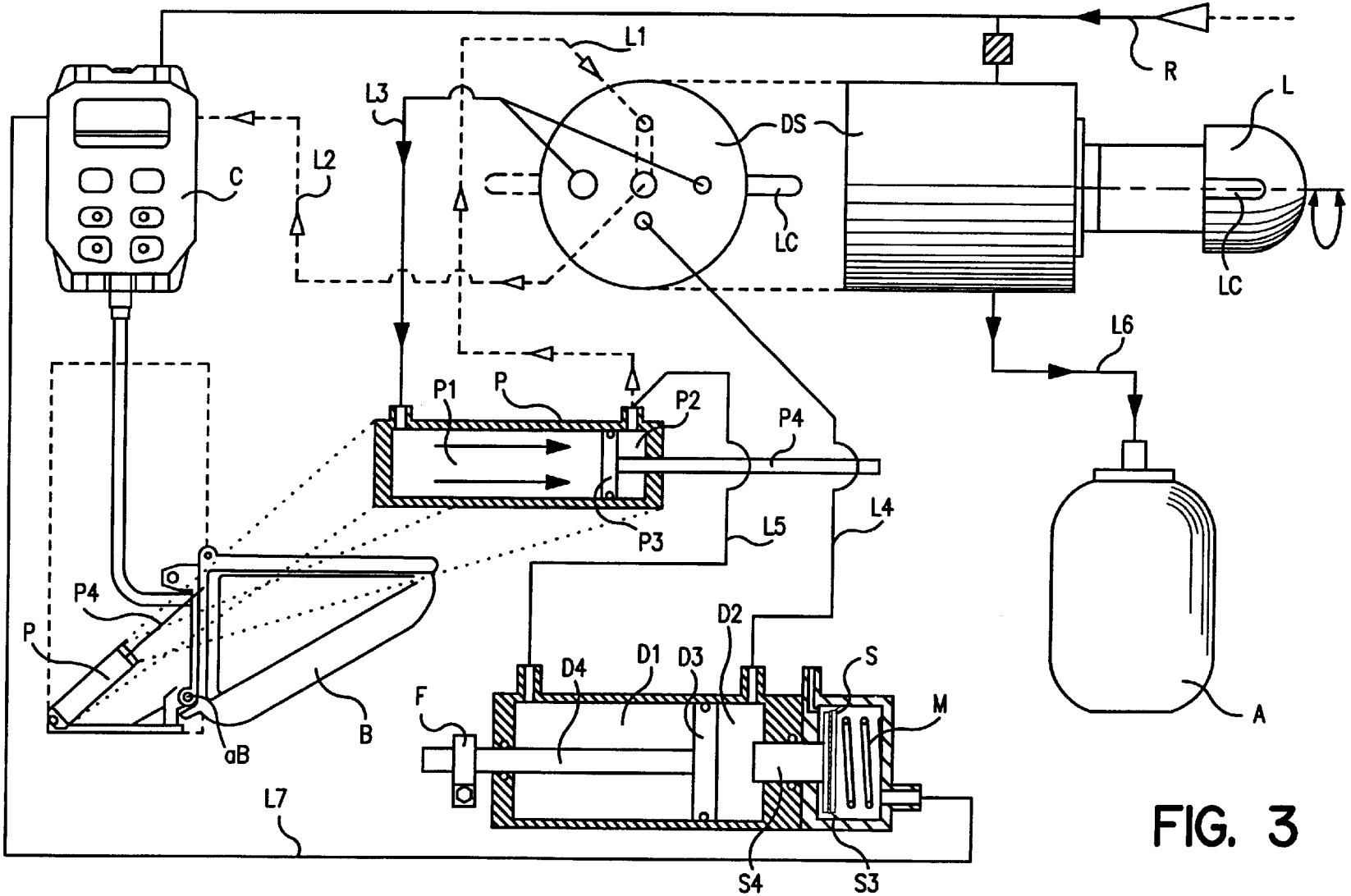
FIG. 3 shows the system of FIG. 2 in an opening step in which the sanitary fixture is turned into an extracted or in-use position.

When an operator wishes to use the sanitary fixture, he/she turns the handle or lever LC to the sanitary fixture open position shown in FIG. 3. In the particular embodiment shown the lever is rotated 90° with respect to the rest position, but obviously the rotation angle could be different. In this condition, the cam 8 is rotated in a position wherein it pushes open the ball of the connection valve to the mains water system R. The mains water, through the distributor DS, enters into line L3 until it reaches the chamber P1 of unit P and thereafter moves the piston P3 of unit P to the right in the figures, causing the extraction of rod P4, and the rotation of the sanitary fixture B around its rotation axis aB, from its retracted position to its extended or in-use position as shown in FIG. 3. The water in chamber P2 of the cylinder-piston unit, due to the thrust effect is sent through lines L1, L2 to the discharge and accumulation flush tank C, passing through distributor DS. From this position it is possible to return to the rest position by closing the sanitary fixture without involving discharge, or to receive washing water as will be stated later.

Figure 4:
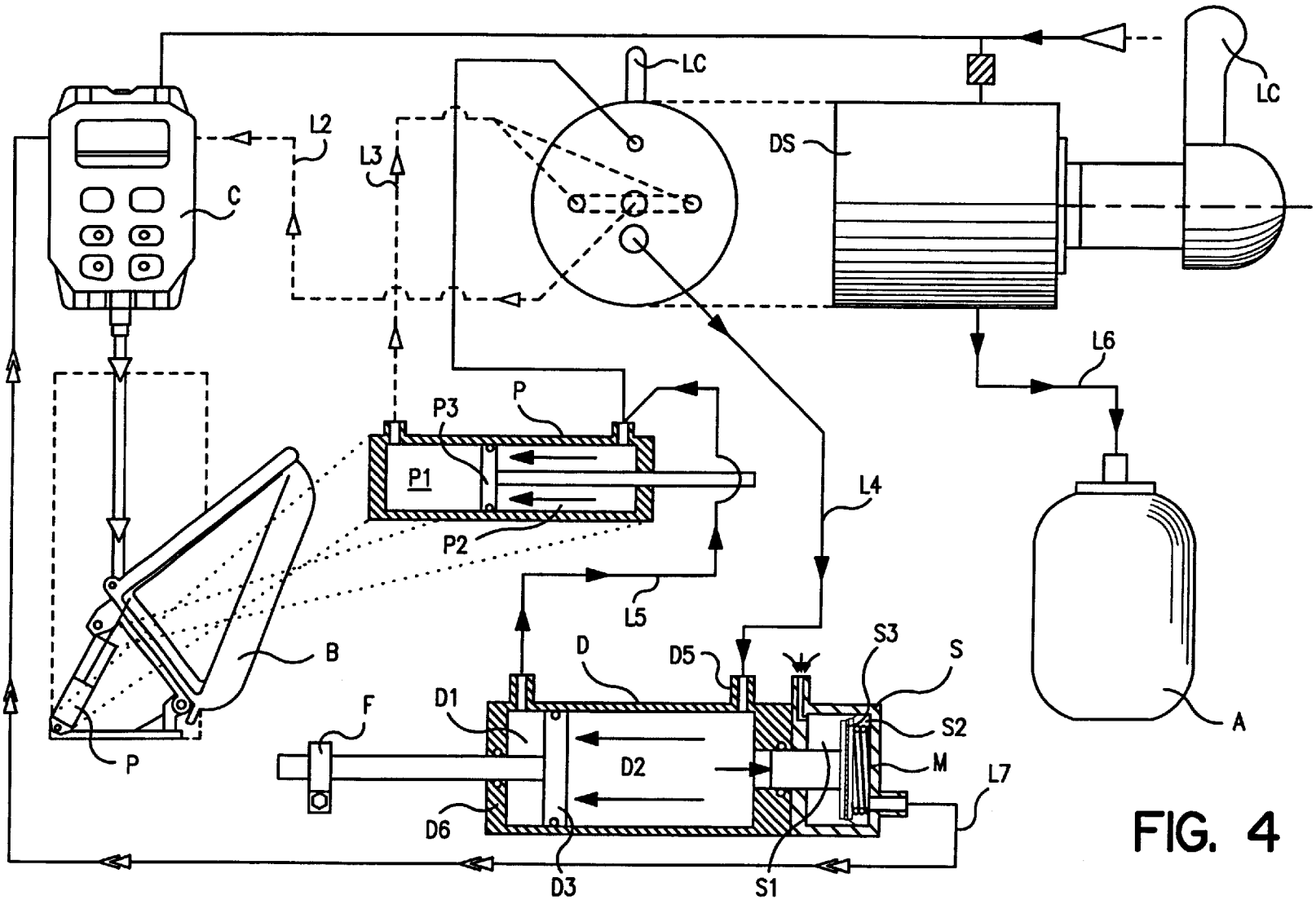
FIG. 4 shows the system of the previous figures in a flush tank discharge-and-partial-turnover-of-sanitary-fixture step.

FIG. 4 shows the condition of discharge and initial turnover or tilting of the system. The operator turns the lever LC of the distributor DS to a third position that corresponds precisely to the discharge-turnover position. In this situation the distributor DS feeds water through pipe L4 to chamber D2 of the metering and discharge actuator device DA. The water pressure in D2 at first moves the piston S3 against the action of spring M, thus causing an air bias through line L7 until the flush tank C, primes the water discharge or outlet. Then water, continuing to flow through line L4, causes piston D3 to slide and contract chamber D1. This, through line L5, causes the water to flow into chamber P2 of cylinder-piston unit P. This, in turn, causes piston P3 of unit P to slide and the sanitary fixture B to retract or rotate around its hinge aB through an angle defined by the stroke of piston P3, in turn defined by the stroke of piston D3.

Figure 6:
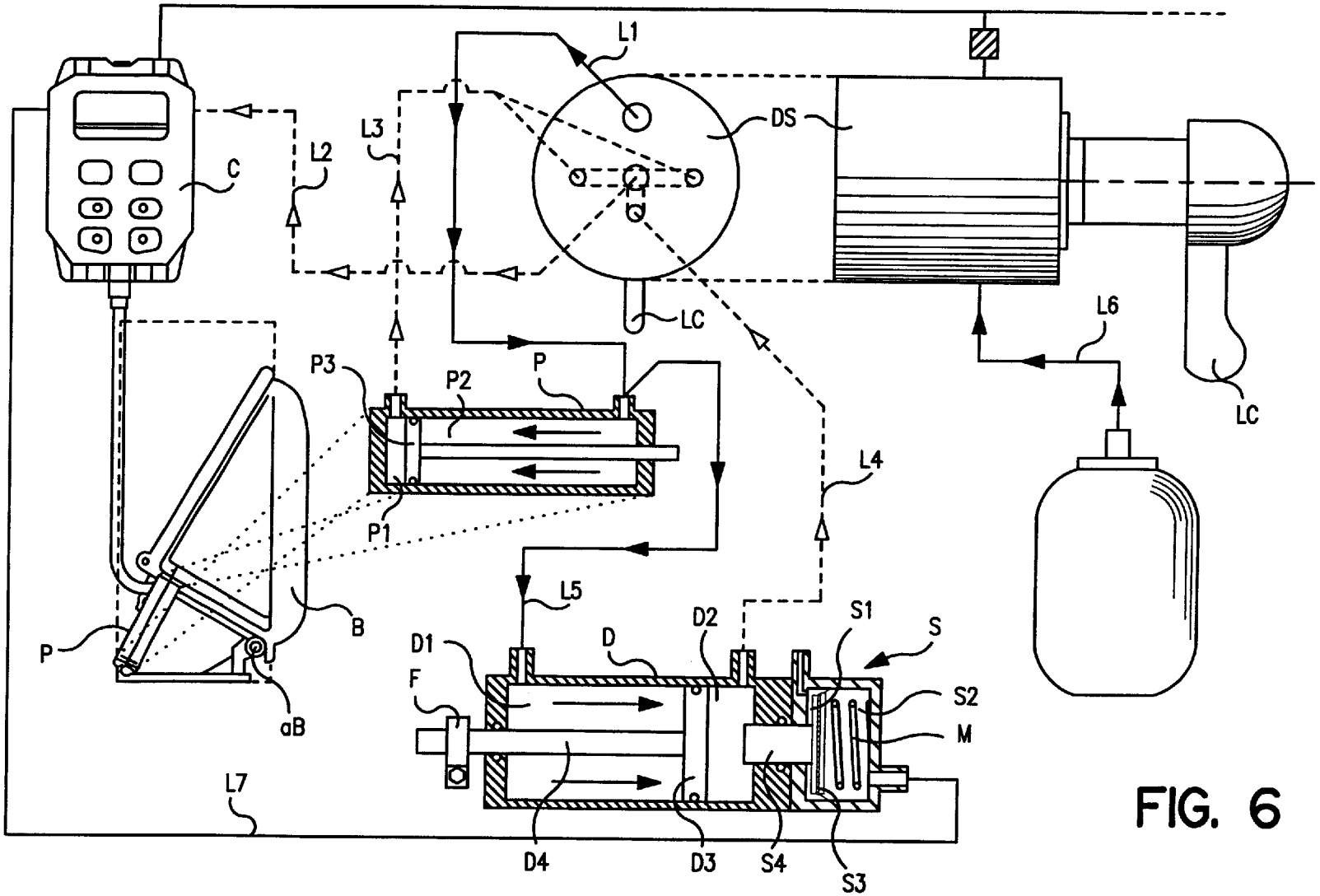
FIG. 6 shows the system of the previous figures in a closing step.

The complete closure of the sanitary fixture takes place as shown in FIG. 6, by turning the lever LC to the closing position (FIG. 6).

In this position, the passage for mains water is blocked, and a passage between the expansion tank A and the distributor is established as well as a passage between the latter and line L1. Through line L1 the water pressure moves the piston P3 further until the sanitary fixture is closed. The water contained in P1 flows out through L3 into DS and then through L2 flows into flush tank C. Water, through line L1, having filled chamber P2 passes, by way of the pipe L5, up to D1 causing D3 to move. The water in D2 is sent to the distributor through line L4 and from there to the accumulation tank C through L2. The system is ready to be used again.

Figure 5:
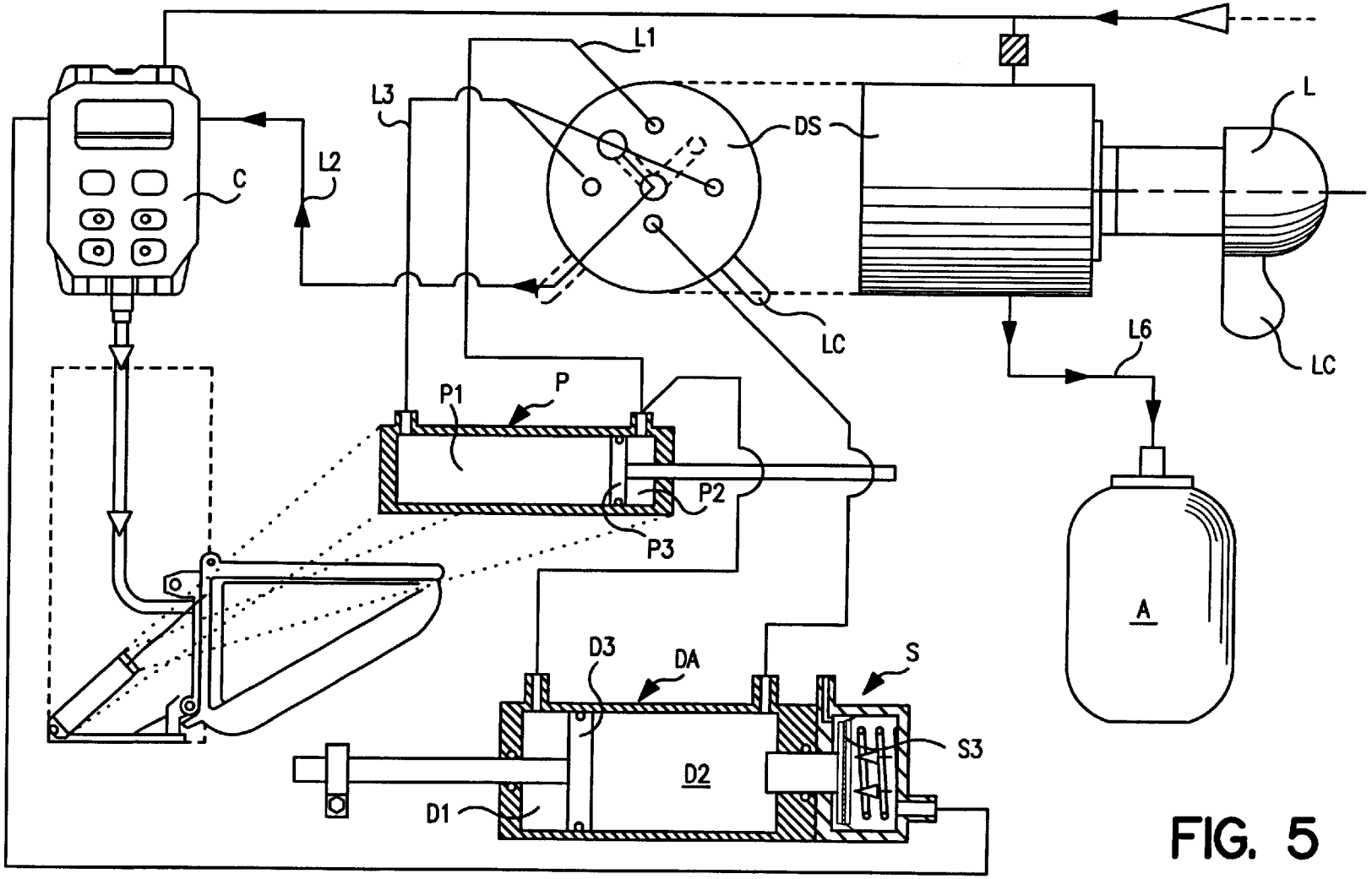
FIG. 5 shows the system of the previous figures in a washing or water request step.

FIG. 5 shows an intermediate washing position. It may occasionally be desirable to provide for mains water washing of the sanitary fixture for more thorough cleaning. In this case, the distributor lever LC is turned to a washing position, for example at 45° with respect to the initial or rest position. When the distributor is in this position it allows a direct passage of mains water to line L2 and then, through the overflow provided by flush tank C, the water drains directly into the sanitary fixture.

Figure 9:
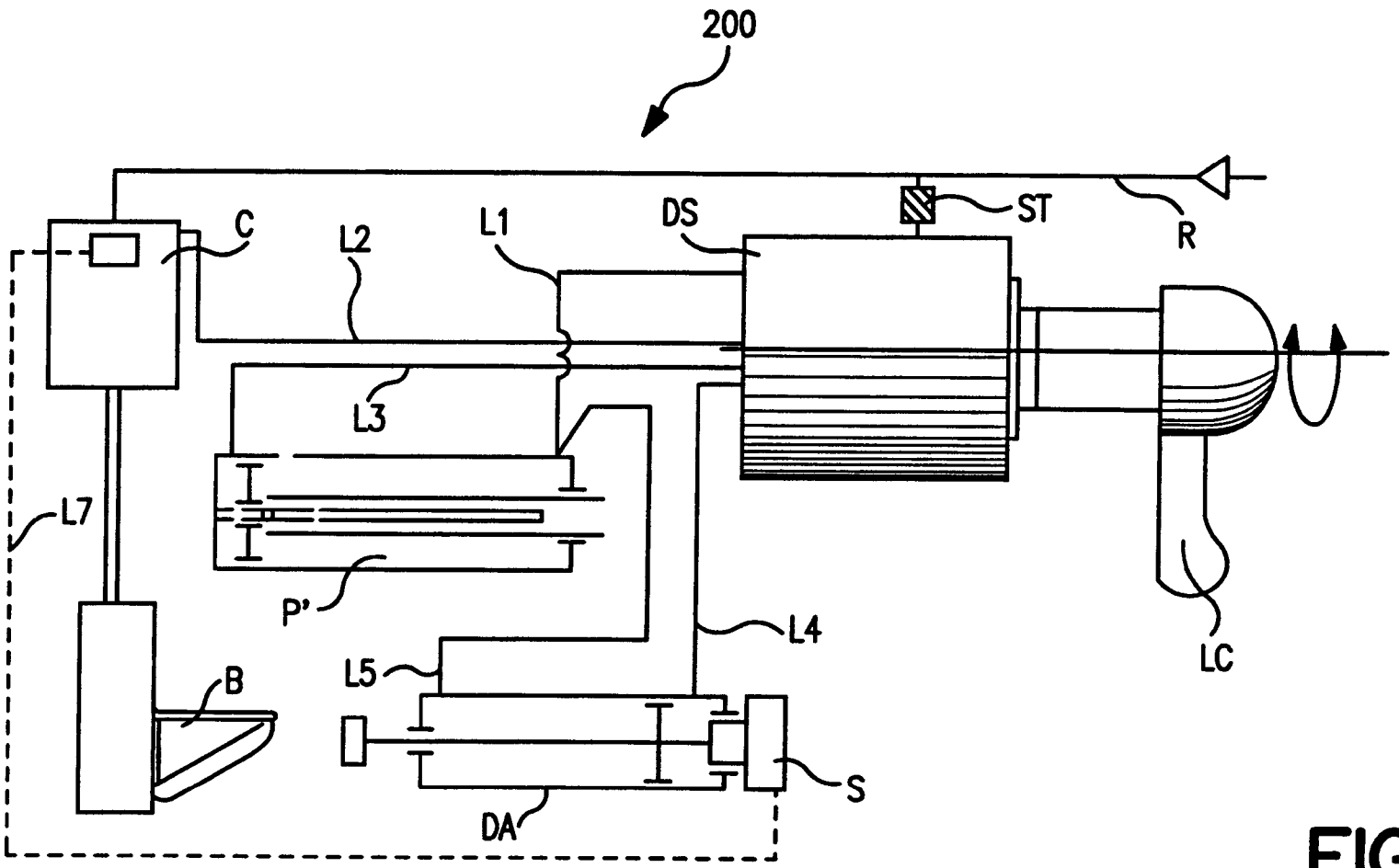
FIG. 9 shows a modified embodiment of the previous system, equipped with a safety piston device P'with the exclusion of the membrane tank A.
Figure 10:
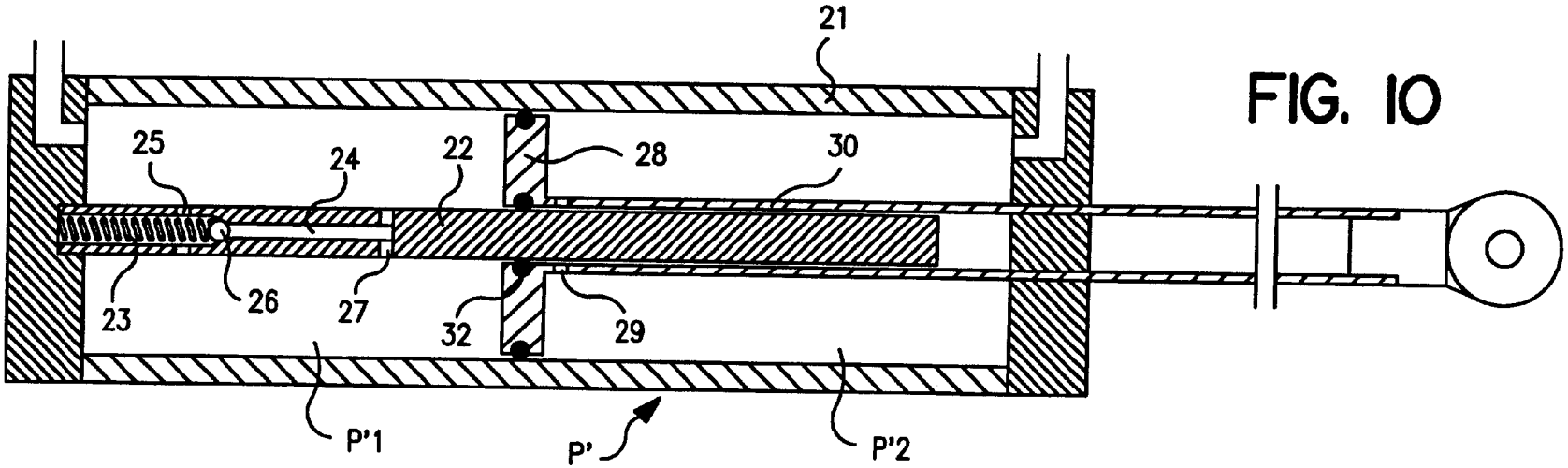
FIG. 10 shows, in axial sectional view, the safety piston device for the system in FIG. 9 in an intermediate position.
Figure 12:
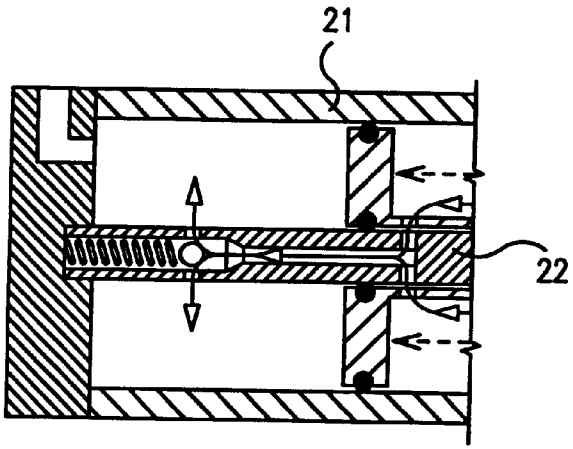
FIGS. 11 to 16 show, in similar sections to FIG. 10, interrupted, various possible positions for the safety piston device of FIG. 10.
Figure 11:
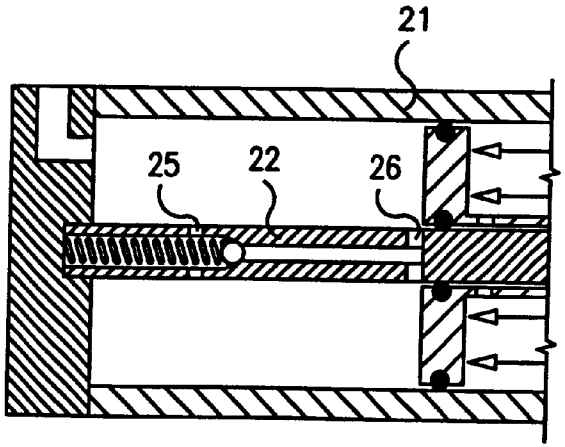
Figure 14:
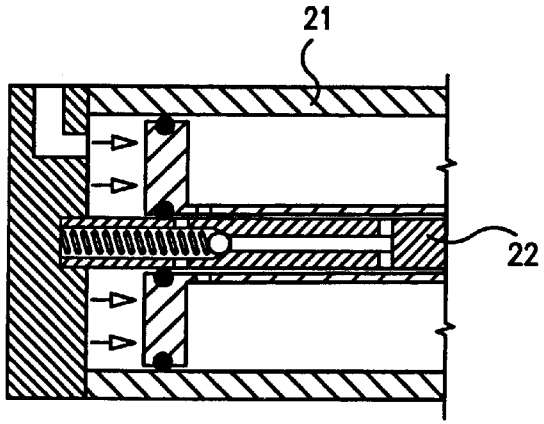
Figure 16:
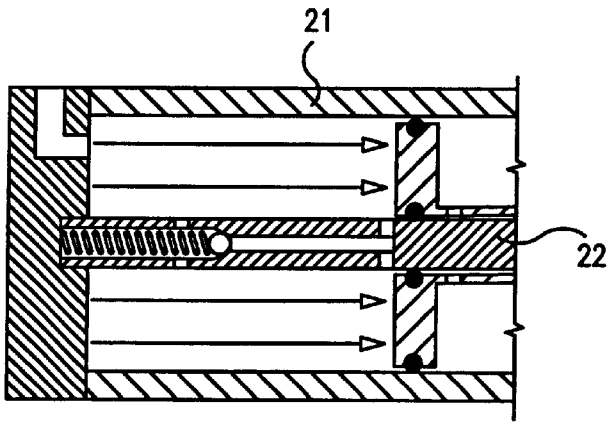
Figure 13:
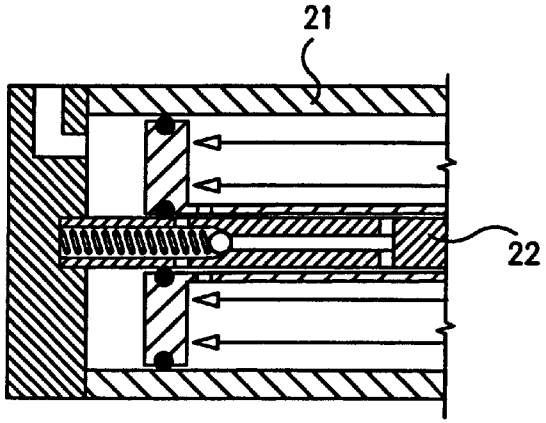
Figure 15:
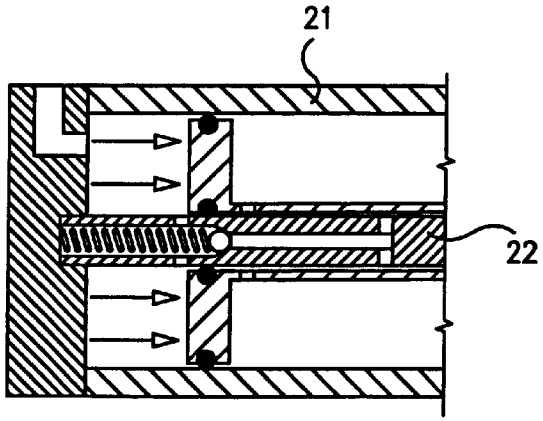

A second type of toilet or WC system is outlined in FIG. 9 and referenced 200. The second system maintains, as much as possible, the previous system's references: B is the rotating hideaway sanitary fixture, C the discharge and accumulation flush tank, DS the distributor, DA the metering and discharge actuator device. The system does not include an expansion tank. The sanitary fixture's extraction and retraction unit(s) is/are different from previous ones and denoted by P'. The system further includes fluid lines L1, L2, L3, L4, L5, L7 similar to those of the system in FIG. 1 with similar functions, therefore they need not be described in detail.

The safety piston P' will be described in detail with reference to FIGS. 10 to 16. It allows an initial limited closure step of the sanitary fixture, therefore a closure step of reduced strength, to prevent accidents.

The cylinder-piston safety unit includes a cylinder 21 equipped with an axial rod 22, fixed to a cylinder end cap. The rod has a length of axial channel 24 communicating radial bores or passages 25 and 27. A check valve in the rod includes a ball 26 and a spring, 23, biasing the ball 26 to close the channel 24. The closing position for the ball 26 is between radial passages 27 and 25.

Piston 28 is fixed to a hollow rod 30 so as to run freely along and around the fixed rod 22. The hollow rod has radial bores 29, and an internal seal 32 in sealing engagement with fixed rod 22. During the closing step, when seal 32 of piston 28 has passed over distal radial bores 27 in fixed rod 22, water passes from chamber P'2 to P'1 through radial bores 27, axial bore 24, check valve 26, radial bores 25, and interrupts the piston's closing action. However, sanitary fixture B does not stop completely, as the safety device is activated only when the sanitary fixture's center of gravity has passed the rotation axis, and therefore will still tend to close, but with very limited energy and safely. Before total closure of the sanitary fixture and hence before the end of piston stroke P'3, the seal 32 will go beyond the radial bores 25 on the fixed rod 22 thus interrupting the transfer of water from chamber P'2 to chamber P'1 and restoring the closing action of piston P' that will finish its stroke by closing the sanitary fixture and keeping it closed. During the opening step of the sanitary fixture, the safety device is not activated, since the check valve prevents the water passing from chamber P'1 into chamber P'2.

It should be noted that although the check valve 23, 26 is shown comprising a ball and a spring, nevertheless its form may be simplified, should the device be set with a vertical axis, so as to include ball 26 only, provided that it is lighter than water.

Figure 17:
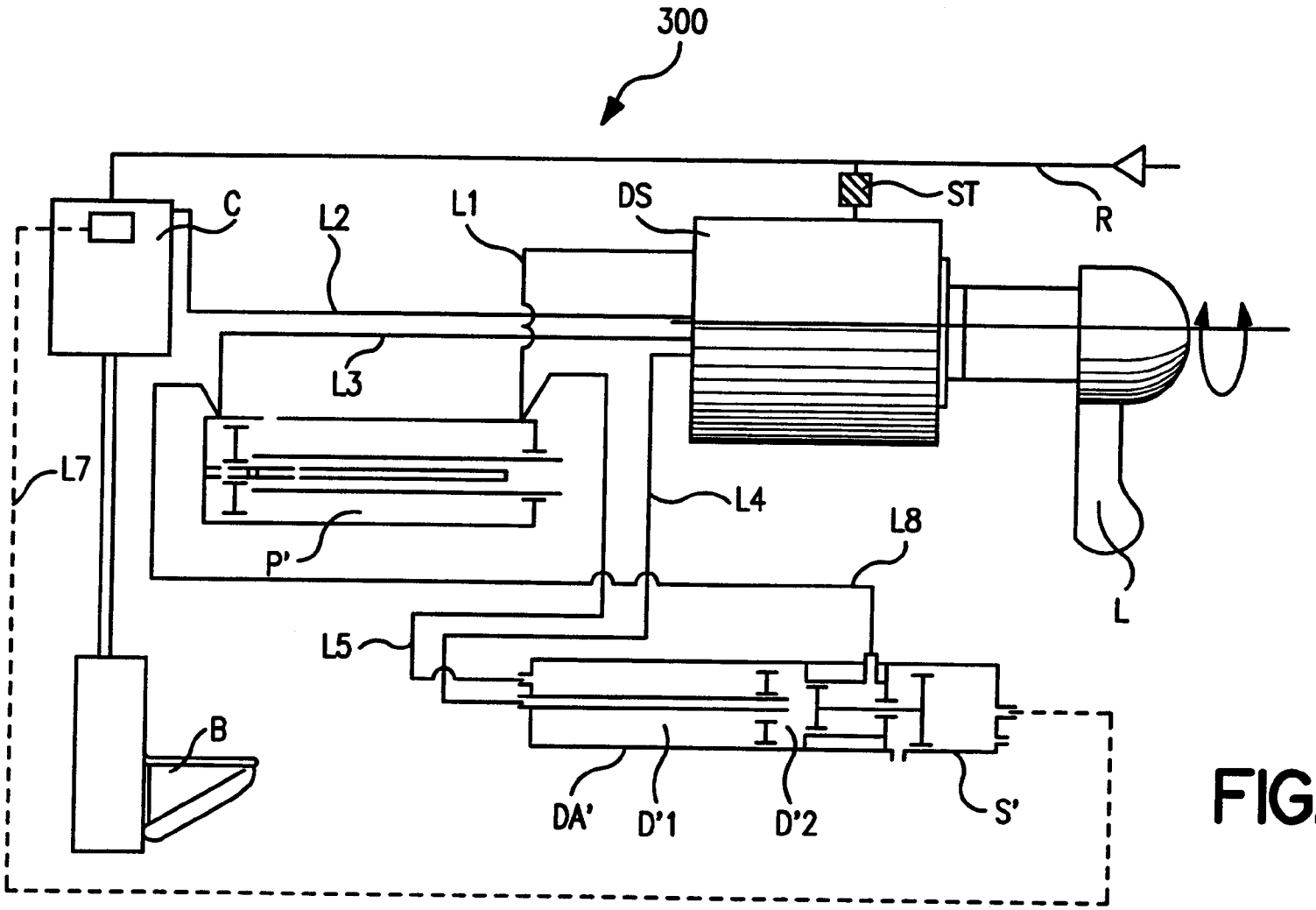
FIG. 17 shows a further modified embodiment of the previous system, equipped with the safety piston device P' with the exclusion of the membrane tank A; and equipped with a specially configured metering and discharge actuator device DA'.
Figure 18:
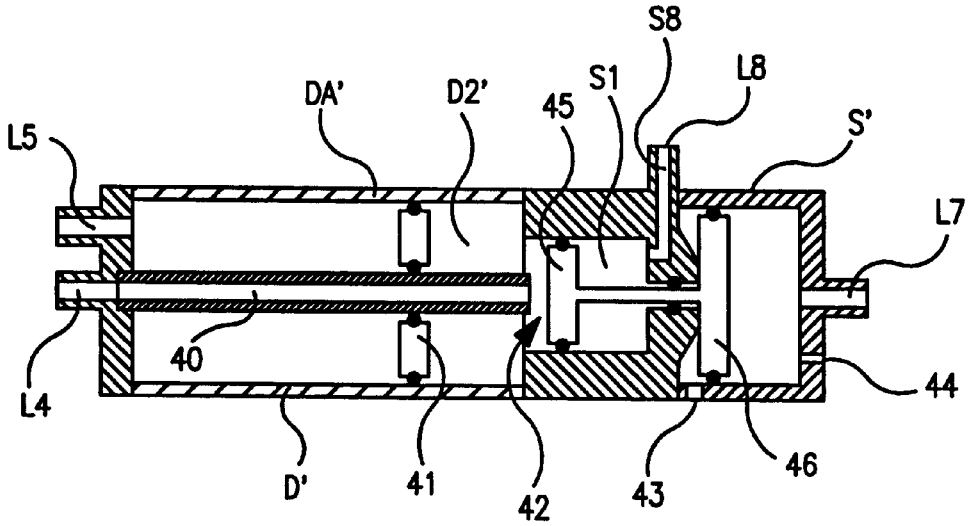
FIGS. 18 to 24 shows the metering and discharge actuator device of the system in FIG. 17 during various operating steps.
Figure 19:
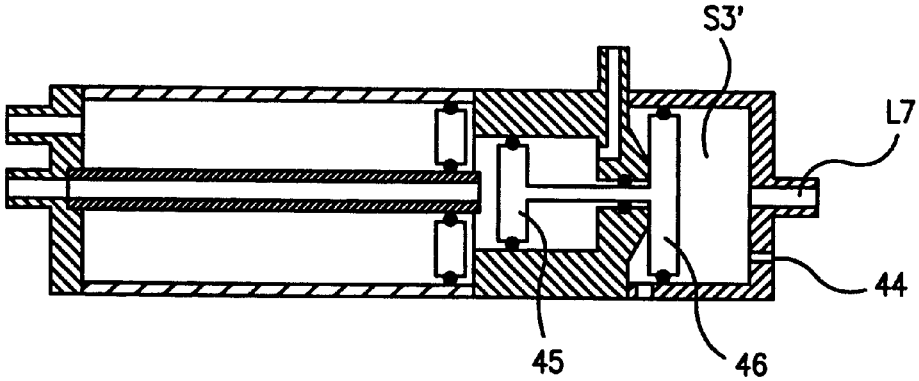
Figure 20:
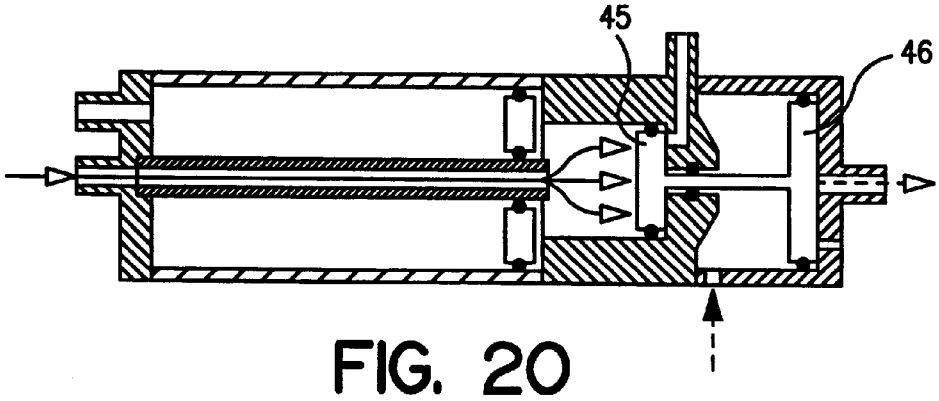
Figure 21:
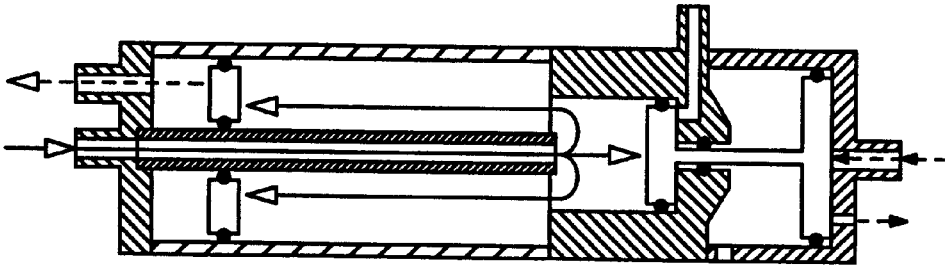
Figure 22:
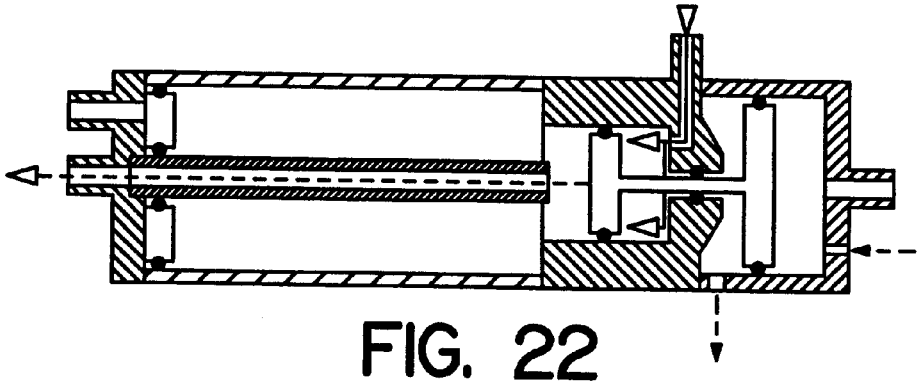
Figure 23:
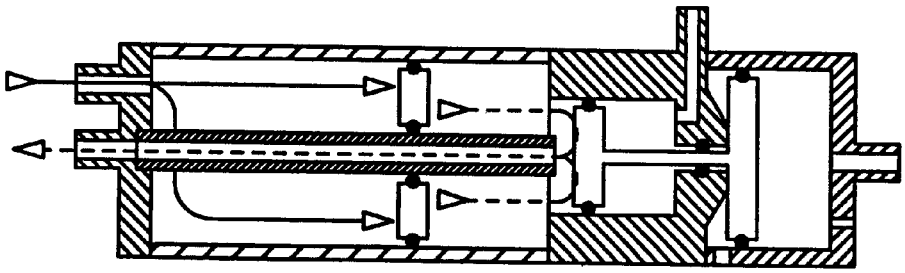
Figure 24:
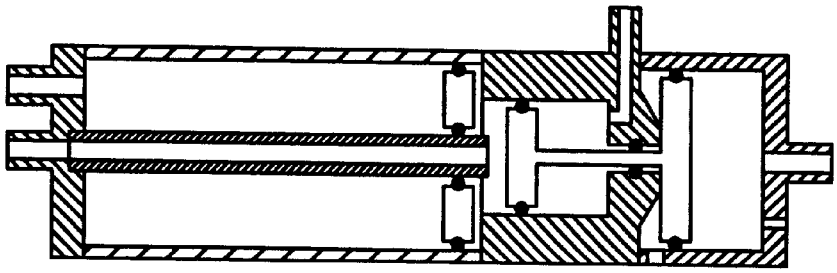

FIGS. 17 to 24 show another type of system denoted by 300 and precisely FIG. 17 shows the system and FIGS. 18 to 24 show a metering and discharge operating device of the system during the various stages of operation.

System 300 includes a connection R to the water supply system with or without an adjustable pressure stabilizer ST, a cylinder-piston safety unit P' (like the system 200), a discharge and accumulation flush tank C for a rotating hideaway sanitary fixture B and a metering and discharge device which will be discussed further on. The fluid connection pipes are referred to using the same references as the previous system's pipes.

The metering and discharge operating device is referenced DA' as a whole and includes a fixed tubular rod 40, and a piston 41 slidable on it. Rod 40 is connected to the fluid line L4 at one end and has the other end leading to chamber D2' of the metering device portion D'. The line L5 ends up in chamber D1.' The discharge operating device S' includes a twin head piston 42 having two heads 45, 46 connected by a rod. The head 45 defines chamber D2' in the metering device D' and a chamber S1' fed by water, from chamber P1' of the unit P' through line L8. The head 46 defines two chambers, S2' communicated with the atmosphere through bore 43, and S3' connected to line L7 and communicating with the atmosphere through small diameter bore 44. The bore 44 proves unimportant during the thrust of compressed air for the attainment of discharge, whereas it allows the membrane of the flusher in the tank to slowly return to the rest position (and hence for the flush tank cap to shut) to allow renewed filling of the flush tank and interrupt the water flowing from the flush tank to the vessel upon termination of the discharge, in circumstances when the distributor is left in the discharge position.

Figure 25:
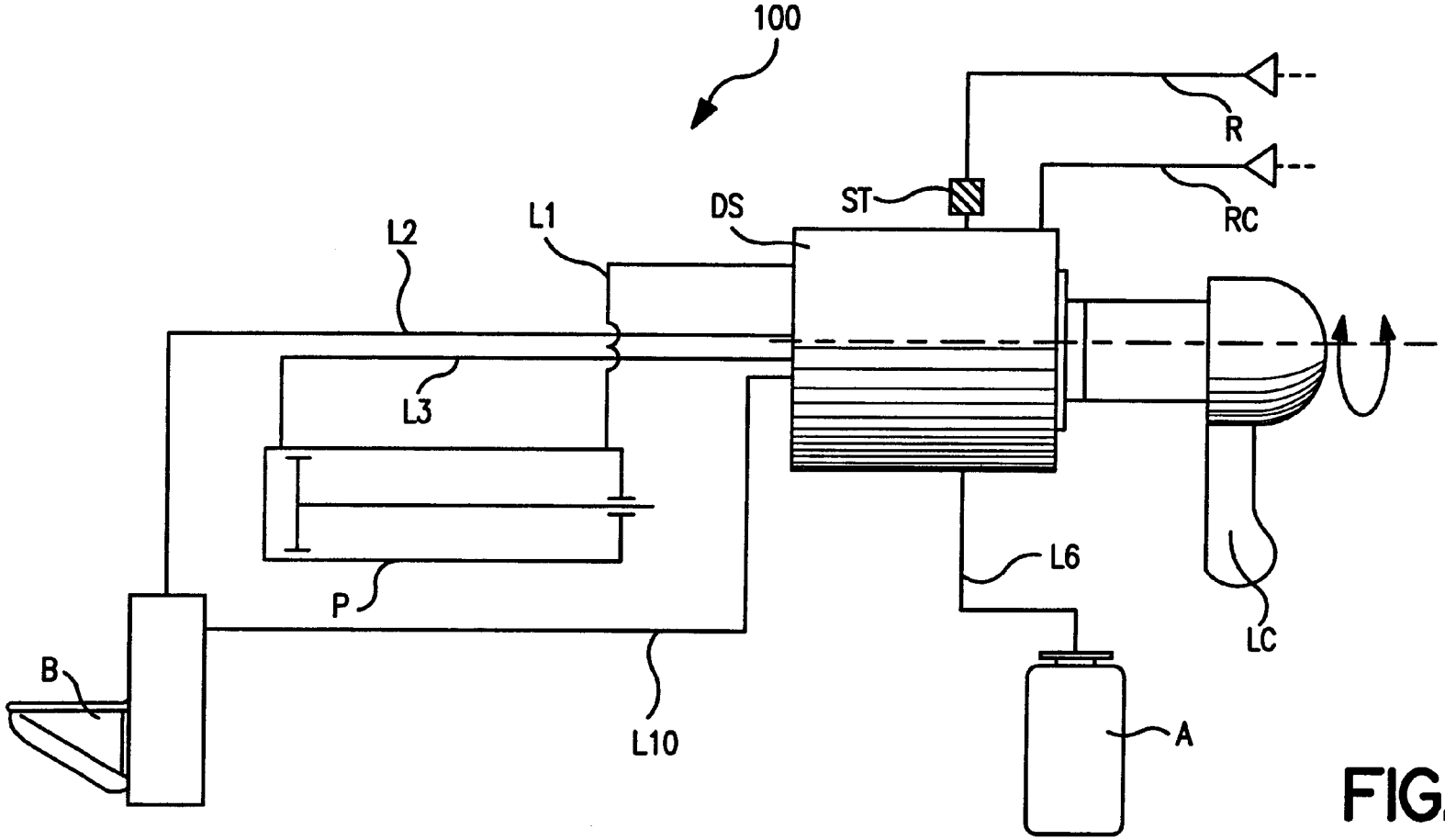
FIG. 25 is a diagrammatically drawing of an operating and feed system of a bidet sanitary fixture B, with the distributor DS in bidet configuration, the membrane tank A, the hydraulic piston P, the cold water supply or feed, R, and hot water supply or feed, RC.
Figure 26:
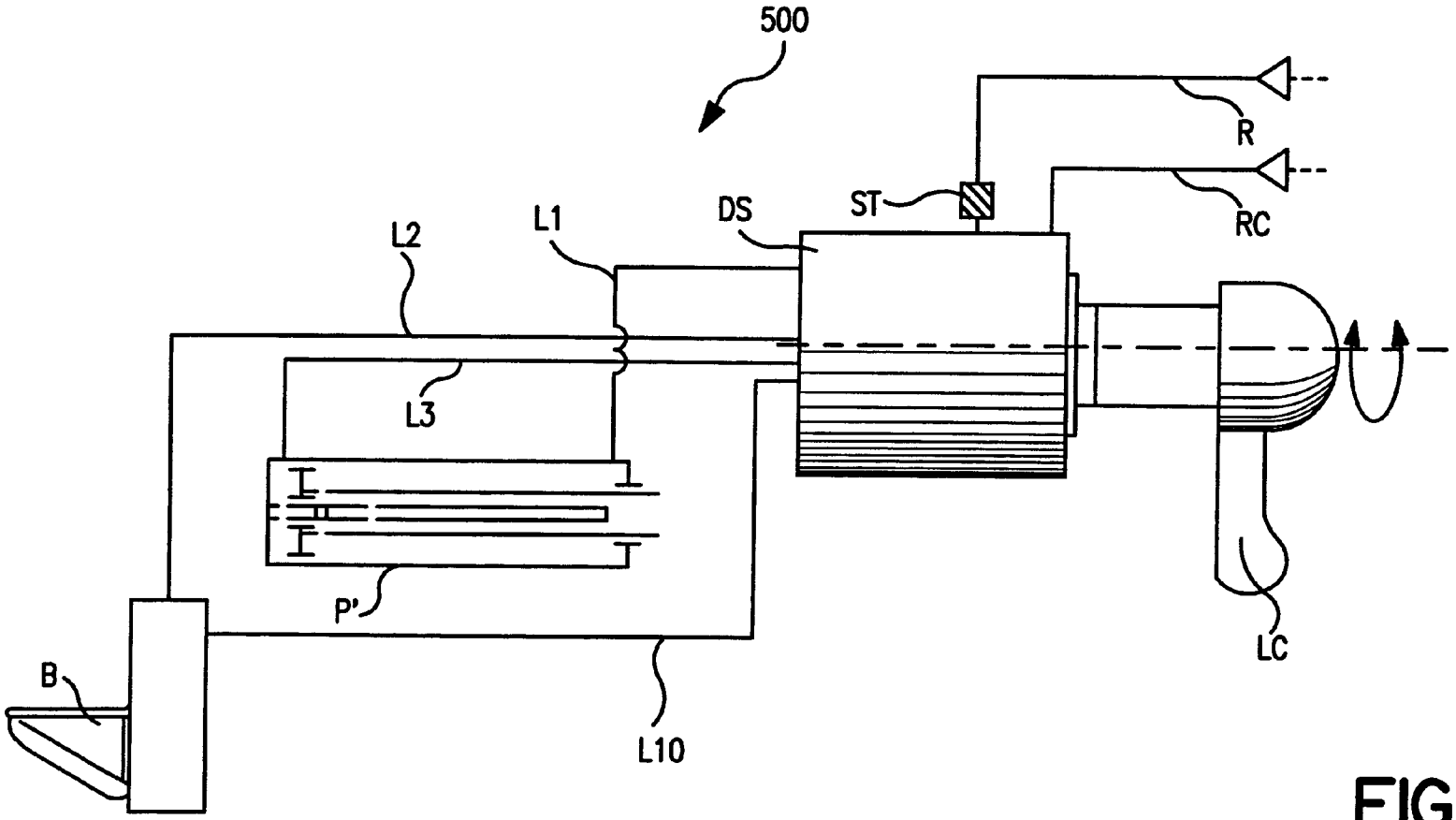
FIG. 26 diagrammatically shows a modified embodiment of the system in FIG. 25, having a safety piston P' and deprived of the membrane tank A.

FIGS. 25 and 26 concern systems for a bidet sanitary fixture. They have kept as far as possible the references of the previous figures, and the corresponding parts will not be explained further.

The system 400 in FIG. 25 includes a connection R to the cold water supply system and a connection RC to the hot water supply system. The distributor DS also serves as a mixer. Obviously, the system does not include a flush tank. Instead, it includes a mixed water supply line L10.

The system 500 in FIG. 26 is similar to that in FIG. 25 except that it uses a safety unit p' (as described previously) for the opening and closing of the sanitary fixture.

What is claimed is:

1. A sanitary toilet system comprising in combination:

(a) a distributor valve coupled to a water supply, said distributor valve having a plurality of selectively operative positions including an open position and a closed position, (b) a sanitary fixture mounted for rotation between a retracted position and an extended position, (c) a hydraulic cylinder assembly coupled to said distributor valve and connected to said sanitary fixture for causing rotation of said sanitary fixture between said extended and retracted positions, and (d) a metering cylinder coupled between said hydraulic cylinder assembly and said distributor valve for charging said cylinder assembly with a predetermined amount of water during retraction of said sanitary fixture.

2. The sanitary toilet system of claim 1 further including a flush tank coupled to said sanitary fixture and to said distributor valve to receive said predetermined amount of water from said hydraulic cylinder when said distributor valve is placed in an open position.

3. The sanitary toilet system of claim 1 wherein said hydraulic cylinder system retracts with a predetermined amount of force for a first portion of a stroke, and which includes a piston having a construction for providing an intermediate retraction position at which said cylinder assembly retracts with a force weaker than said predetermined force for the remainder of said stroke.

4. The sanitary system of claim 1 wherein said water supply is a mains water system.

5. The sanitary system of claim 1 wherein said water supply is an auxiliary expansion tank.

6. A sanitary toilet system comprising in combination:

(a) a source of mains water supply;

(b) a distributor valve system operatively selectively coupled to the mains water supply;

(c) a sanitary fixture mounted for rotation about an axis between an open position and a retracted position;

(d) a flush tank coupled to the sanitary fixture;

(e) a piston and cylinder connected to the sanitary fixture for causing rotation of said fixture between said open and retracted positions, said cylinder being coupled operatively to said mains water supply through said distributor valve system so as to extend said piston and thereby rotate said fixture to its open position when said distributor valve is in a first position and to retract said piston and rotate said fixture to its retracted position when said distributor valve is in a closed position; and (f) a metering system coupled to said piston and cylinder for charging said cylinder with a predetermined amount of fluid while thereby retracting said sanitary fixture when said distributor valve is in said second position, the metering system having a first line coupled to an end of said piston and cylinder and a second line coupled to said distributor valve system, wherein said metering system further includes a piston and air cylinder for providing an air bias output coupled to said flush tank.

7. A sanitary toilet system comprising in combination:

(a) a source of mains water supply;

(b) a distributor valve system operatively selectively coupled to the mains water supply;

(c) a sanitary fixture mounted for rotation about an axis between an open position and a retracted position;

(d) a flush tank coupled to the sanitary fixture;

(e) a piston and cylinder connected to the sanitary fixture for causing rotation of said fixture between said open and retracted positions, said cylinder being coupled operatively to said mains water supply through said distributor valve system so as to extend said piston and thereby rotate said fixture to its open position when said distributor valve is in a first position and to retract said piston and rotate said fixture to its retracted position when said distributor valve is in a closed position, wherein said piston and cylinder includes a construction for altering the degree of force with which said piston and cylinder is caused to retract at a predetermined point in a retraction stroke so as to lessen the force with which said sanitary fixture assumes said retracted position.

8. A sanitary toilet system comprising in combination:

(a) a source of mains water supply, (b) a distributor valve system operatively selectively coupled to the mains water supply, a sanitary fixture mounted for rotation about an axis between an open position and a retracted position, (c) a flush tank coupled to the sanitary fixture, (d) a metering system coupled to said piston and cylinder for charging said cylinder with a predetermined amount of fluid while thereby retracting said sanitary fixture when said distributor valve is in said second position, the metering system having a first line coupled to an end of said piston and cylinder and a second line coupled to said distributor valve system; and (e) a piston and cylinder connected to the sanitary fixture for causing rotation of said fixture between said open and retracted positions, said cylinder being coupled operatively to said mains water supply through said distributor valve system so as to extend said piston and thereby rotate said fixture to its open position when said distributor valve is in a first position and to retract said piston and rotate said fixture to its retracted position when said distributor valve is in a closed position, and wherein said piston and cylinder is coupled to said flush tank through said distributor valve so as to charge said flush tank with said predetermined amount of fluid during an extension stroke of said piston and cylinder.

* * * * *